US010604892B1

(12) United States Patent
Caliri et al.

(10) Patent No.: US 10,604,892 B1
(45) Date of Patent: Mar. 31, 2020

(54) STRING, ROPE, OR STRAP WITH REPETITIVELY SPACED HOLES/FLEXIBLE-EYELETS

(71) Applicants: John Stephen Caliri, Mt. Baldy, CA (US); Joseph Mark Caliri, Mt. Baldy, CA (US)

(72) Inventors: John Stephen Caliri, Mt. Baldy, CA (US); Joseph Mark Caliri, Mt. Baldy, CA (US)

( * ) Notice: Subject to any disclaimer, the term of this patent is extended or adjusted under 35 U.S.C. 154(b) by 411 days.

(21) Appl. No.: 15/731,119

(22) Filed: Apr. 21, 2017

Related U.S. Application Data

(60) Provisional application No. 62/391,207, filed on Apr. 23, 2016.

(51) Int. Cl.

| | |
|---|---|
| ***D07B 1/00*** | (2006.01) |
| ***D07B 5/00*** | (2006.01) |
| ***D07B 1/14*** | (2006.01) |
| ***D07B 9/00*** | (2006.01) |
| ***D07B 5/04*** | (2006.01) |

(52) U.S. Cl.
CPC ..... *D07B 5/005* (2013.01); *D07B 1/148* (2013.01); *D07B 5/04* (2013.01); *D07B 9/00* (2013.01); *D07B 2201/104* (2013.01); *D07B 2201/1096* (2013.01)

(58) Field of Classification Search
CPC ..... D07B 1/185; D07B 5/005; D07B 2201/1096; F16G 11/14; D04C 1/06
See application file for complete search history.

(56) References Cited

U.S. PATENT DOCUMENTS

| | | | | |
|---|---|---|---|---|
| 936,492 | A * | 10/1909 | Thun et al. | D04C 1/06 |
| 2,879,687 | A * | 3/1959 | Leimbach | D04C 1/06 87/37 |
| 4,405,034 | A * | 9/1983 | Dunne | E06C 1/56 182/100 |
| 5,209,712 | A * | 5/1993 | Ferri | A61H 1/02 482/131 |
| 7,845,609 | B2 | 12/2010 | Bernard | |
| 8,347,772 | B2 | 1/2013 | Dow et al. | |
| 9,150,999 | B2 | 10/2015 | Dahl | |
| 9,151,358 | B2 | 10/2015 | Dahl et al. | |
| 9,622,566 | B1 * | 4/2017 | Pinholster, Jr. | A45F 3/22 |

* cited by examiner

*Primary Examiner* — Tajash D Patel
(74) *Attorney, Agent, or Firm* — Mersenne Law

(57) ABSTRACT

A string, rope, or strap with repetitively spaced openings/flexible eyelets from bifurcated braiding or weaving, or from cutting and sealing. The bifurcated openings are preferably created from a single rope or strap that is subsequently braided or weaved into two strings, ropes, or straps and then back into one. The frequent and periodic placement of these eyelets on the string, rope, or strap, allows the user to easily tie down items. The rope or strap is flexible enough to pull it in on its self, through its eyelets. The ends of the string, rope, or strap are finished into a hard tip.

23 Claims, 4 Drawing Sheets

STRING, ROPE, OR STRAP WITH REPETITIVELY SPACED HOLES/FLEXIBLE-EYELETS

CROSS-REFERENCE TO RELATED APPLICATIONS

This is a continuation of provisional application No. 62/391,209 filed Apr. 23, 2016 and entitled 'Rope With Repetitively Spaced Openings/Eyelets'.

BACKGROUND OF THE INVENTION

(1) Field of the Invention

The present invention relates to string, rope, or strap that is braided, twisted, or woven, specifically with a repetitive structural addition. The structural addition being a bifurcation and reunification of the main string, rope, or strap.

(2) Description of Related Art

For thousands of years people have been making string, rope, and strap out of a huge selection of materials, and with innumerable methods. This was done not just to find a stronger and better cord, but because certain cordage is better for certain tasks. In modern times this is truer than ever, and couldn't be more obvious for someone skilled in the arts. That is why still today people are working on developing new fibers and constructions.

There are all different types of braids and weaves for rope, strap, and the like. Bifurcation is nothing new; it has been seen in things like nets, slings, loops on rope, and other rope products. Now there are braiding machines that can be programmed to braid all sorts of different thing, including all sorts of bifurcated braids. There are also braiding machines that are made just to braid a specific bifurcated braid type, like U.S. Pat. No. 8,347,772 B2.

Splicing also has a long tradition with rope, and is still very much in use. There are hundreds of splices that are used for many different purposes. One of the most popular is the eye splice, which is a loop at the end of a rope that acts as a permanent solution instead of tying a looped knot Unfortunately, even after an eye splice is achieved the rope only has the one permanent loop in it at the very end of the rope. Other splices like the cut splice might look very similar to the presented inventions eyelets, but there are quite a few differences. A cut splice is done after the rope is made, not during, and is used to join two pieces of rope together, it is not necessarily intended to be used in the fashion of the present invention.

When rope or strap is used in general tie down or securing applications, like tying things down in the back of pickup trucks, cargo vans, and box trucks, people simple tie looped knots when needed. These looped knots that won't come out, sometimes create permanent loops unintentionally. Although these loops can be and are some times used again, they are still more of an annoying obstruction than a benefit, because of their protruding nature. The present invention essentially puts loops equally spaced along the rope or strap without them being an obstruction.

When it comes to general tie down applications there have been a lot of different products and innovations to assist conventional rope and strap in securing items. Some of these include ratcheting systems, netting, bungee cords, ropes with protruding loops, and all sorts of other things. However, sometimes it is still faster and/or better to just use rope or strap with out all the fancy gimmicks, that is why the present invention seeks to be capable of the same manipulation as conventional rope or strap, but with added attributes.

Ropes with protruding loops are the closest to the present invention that are on the market today, like U.S. Pat. No. 9,150,999 B2. The problem with tie downs with protruding loops is that those loops get caught when you go to pull it through a securing point or another loop. Another problem specifically with the cited loop rope assembly is that it allows for the loops to change sizes, thus further complicating things when tying down a load with no slack. Also, unlike the present invention, it does not get to claim the strength of both of the strands making up the loop, one is taught, as the other is not. And of course the most important reason against any sort of protruding loop rope, it cannot be knotted like a conventional rope.

SUMMARY OF THE INVENTION

The invention comprises a the string, rope, or strap with what can be defined and understood most simply as having a deliberate hole, slit, or flexible eyelet in it, in a repetitive manner. Each end of the string, rope, or strap leading up to the eyelet, is at least as long as the body segments that lie in between the eyelets, but would preferably be longer. The vary tips of the string, rope, or strap may be hardened with resin or an attached piece to make them rigid, and more incline to push through the eyelets when the string, rope, or strap has tension on it. When the string, rope, or strap is folded in half, whether the fold is on an eyelet or on a body segment in between the eyelets, it is symmetrical, in the preferred embodiment.

The eyelets can be made in a multitude of ways including but not limited to bifurcated braiding, bifurcated twisting, bifurcated weaving, or cutting and stitching. The easiest and best way is when braiding or weaving the string, rope, or strap, the threads would separate evenly and continue creating two strings, ropes, or straps and then back into one. Because of the nature of straps opposed to rope or string, the bifurcation to make the eyelets can be made by cutting a slit and reinforcing the area like a buttonhole is formed. They are also made to be as small as possible while still able to fully accomplish their objectives; making the eyelets to large will cause the string, rope, or strap to act less like a traditional string, rope, or strap. In the preferred embodiment, eyelets have an indication form color that the eyelet is there, making it easier to find even when there is tension on the string, rope, or strap; this can be accomplished by bifurcating colored threads accordingly, paintings afterwards, dying afterwards, etc.

The present invention cannot be defined purely by its eyelets, but by the strategic and repetitive nature that the eyelets are subject to. The frequent and periodic placement insures that there are always eyelets near by to substitute for tying looped knots. The placement of the eyelets are equidistant in the preferred embodiment, but can be placed at dissimilar distances if done in a useful repetitive nature that keeps the string, rope, or strap's elements of symmetry. In one preferred embodiment the eyelets are placed approximately 12 inches on center from each other. This allows the user to easily tell how much the string, rope, or strap they have left while in use or it can even be used as a makeshift tape measure.

Some of the goals and objectives of the invention in all embodiments are:

To allow for easy attachment of objects (such as hooks, carabineers, other string, rope, or straps etc.), while not overly compromising the structural integrity of the string, rope, or strap.

To be able to pull the string, rope, or strap in on itself, through one of its eyelets, in order to easily make loops, for the purpose of securing the string, rope, or strap, or objects to the string, rope, or strap.

To be able to tie knots and coil the string, rope, or strap as easy as one would with a regular string, rope, or strap of the same size and material.

That the frequency of the eyelets are sufficient to enable the circumvention of tying looped knots, for tasks like 'truckers knots', or simply securing points.

Some of the goals and objectives of the invention in some embodiments are:

To be able to easily find the eyelets even when the string, rope, or strap has tension on it.

For the hardened tips of the string, rope, or strap to be able to more easily push through the eyelets, when the string, rope, or strap has tension on it, than a string, rope, or strap without the hardened tips.

To be able to use the string, rope, or strap as a sort of makeshift tape-measure.

BRIEF DESCRIPTION OF THE PICTURES

DETAILED DESCRIPTION

The following description represents mostly the preferred embodiments, and it does not limit other possible embodiments that can be reasonably assumed by someone skilled in the arts or sciences of the present invention.

The string, rope, or strap with repetitively spaced holes/flexible eyelets, respectively the present invention as a whole, is indicated by numeral 1, in any of its embodiments. The string, rope, or strap 1 is made of a plurality of strands 2*a*, 2*b* which can be seen in the close ups in FIG. 3A-5B. The strands 2*a*, 2*b* may be braided, twisted, or woven to make the string, rope, or strap 1, but would preferably be braided. The strand 2*a*, 2*b* are made of low stretch or non-stretch fibers such as polyester, Kevlar, Dyneema, etc.

Figure 1:
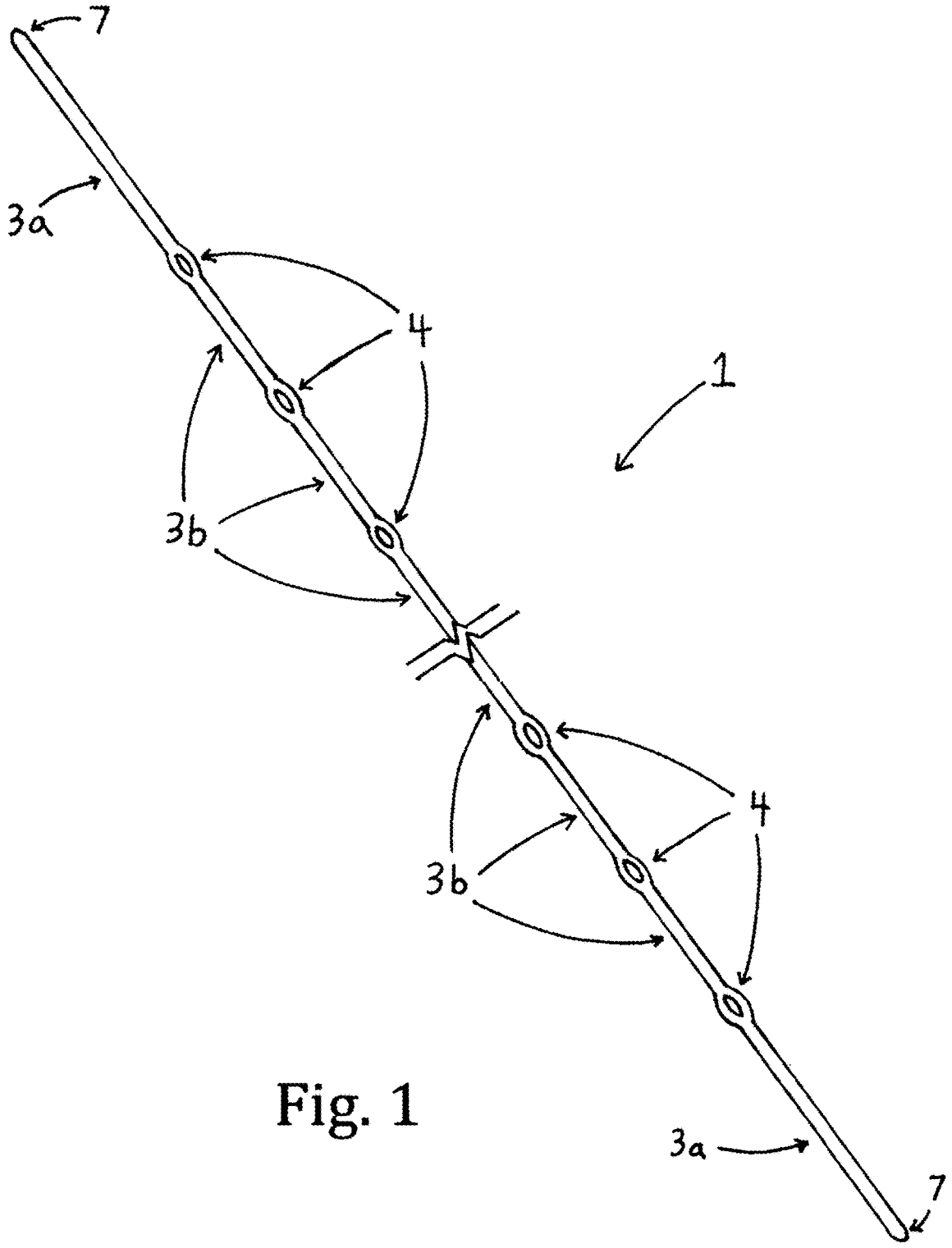
FIG. 1 is a schematic drawing of the string, rope, or strap, in partial, with a flexible eyelet length to main body segment length ratio of 1:6, the end body segments are not part of the ratio; the flexible eyelets are slightly spread open for visual effect.
Figure 2:
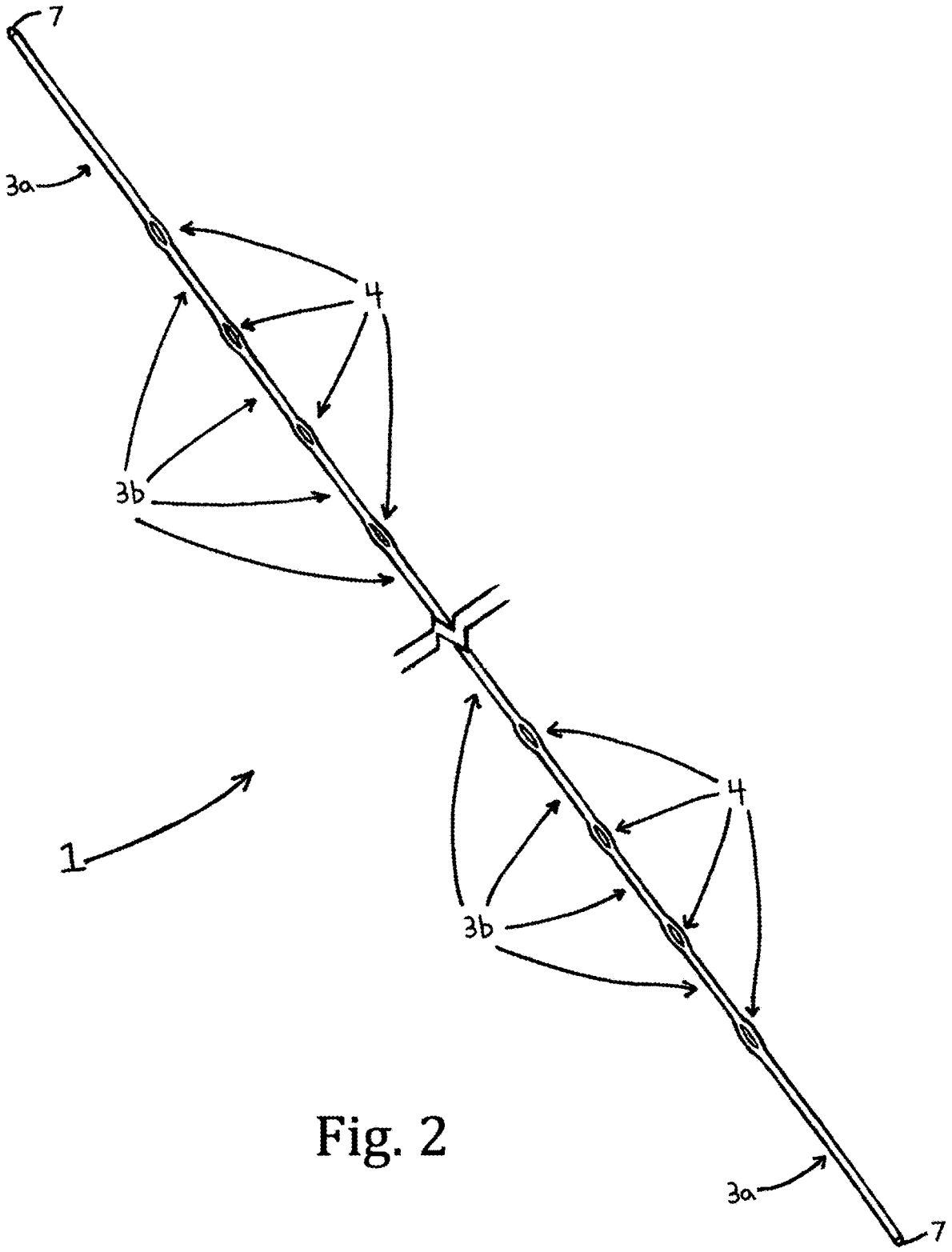
FIG. 2 is a schematic drawing of the string, rope, or strap, in partial, with a flexible eyelet length to main body segment length ratio of 1:5, the end body segments are not part of the ratio; the flexible eyelets are slightly spread open for visual effect.

With references to FIG. 1-2, the string, rope, or strap 1 has body segments 3*a*, 3*b* that may be made circular, square, flat like a strap, etc. In the preferred embodiments the body segments 3*a*, 3*b* are ether circular or flat; both are acceptable and would be subject to the users personal preference. Some people in the industry prefer strap, and use it as if it were traditional rope, because strap is stronger and has more surface area while remaining thin. It is important to note that the end body segments 3*a* that lie between the tip 7 and the first eyelet 4 on each end of the string, rope, or strap 1, is the same as the main body segments 3*b* that lie between the eyelets 4, in every way except that the end body segment 3*a* may be a different length. The end body segments 3*a* should be at least long enough to tie a knot such as a bowline in it, without the eyelets 4 having begun yet. The string, rope, or strap 1 has eyelets 4 that can be defined as a structural portion on the string, rope, or strap 1 in which a body segment 3*a*, 3*b* bifurcates and then reunites, thus forming a deliberate hole. The eyelets 4 are equal in size and spaced strategically along the string, rope, or strap 1, and are generally spaced equidistant from each other. The eyelets 4 in some embodiments can be placed in a set sequence or pattern (not illustrated) if it does not compromise the integrity of the invention's purpose. Set sequences might include, two eyelets 4 separated by a single braiding cycle then the main body segment 3*b*, and repeat. The eyelets 4 are preferably placed equidistant and are frequent enough as to circumvent the need to tie a looped knot. To be effective the exact ratios for the length of the eyelets 4 to body segments 3*b* are subject to the specific string, rope, or strap 1; different thickness or shapes of the body segments 3*a*, 3*b* could beneficially change the ratios. The preferred length of the eyelets 4 to the main body segments 3*b*, can thus be realized through a sort of ratio range, this range should become even clearer as one continues.

Referencing FIG. 1, the string, rope, or strap 1 has a ratio of the eyelets 4 to the main body segments 3*b* of 1:6 respectively. The end body segments 3*a* are longer than the main body segments 3*b*. An exemplary example with this 1:6 ratio which has the eyelets 4 measuring two inches long with the main body segments 3*b* measuring 12 inches long. The end body segments 3*a* are longer than the main body segments 3*b*, in this case about 23 inches long. It is important to note, that in most of the preferred embodiments the ideal length for the eyelet is approximately two inches.

Referencing FIG. 2, the string, rope, or strap 1 has a ratio of the eyelets 4 to the main body segments 3*b* of 1:5 respectively. The end body segments 3*a* are much longer than the main body segments 3*b*. An exemplary example with this 1:5 ratio which has the eyelets 4 measuring two inches long with the main body segments 3*b* measuring 10 inches long. The end body segments 3*a* being about 23 inches long. This way from the tip 7 to the center of the first eyelet 4 is two feet and the center of every subsequent eyelet 4 is another foot; this allows the user to easily count how much feet of rope they have left when tying down a load.

Figure 3A:
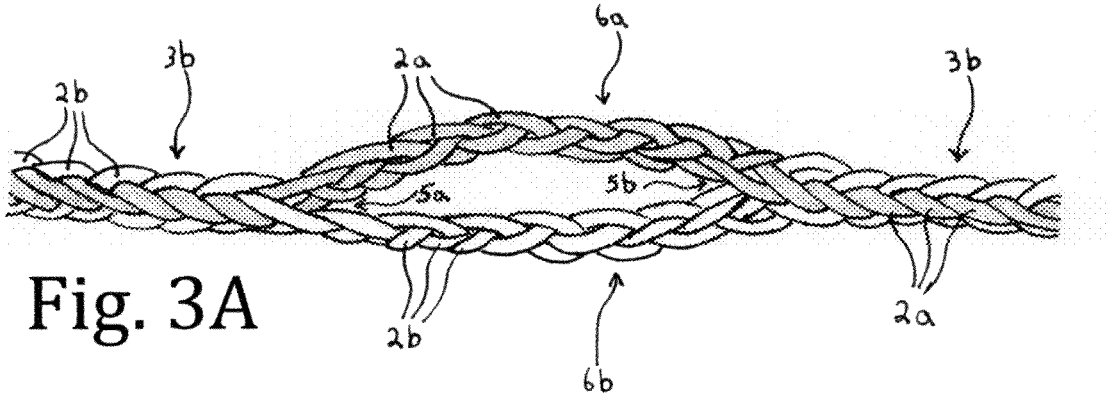
FIG. 3A is a close up drawing of a flexible eyelet spread open on an eight-strand round braided rope.

Referencing FIG. 3A, is a close up of a spread open eyelet 4 on an exemplary embodiment of the string, rope, or strap 1. In this embodiment there are eight strands 2*a*, 2*b*, four are dark colored strands 2*a* and four are light colored strands 2*b*. The eight strands 2*a*, 2*b* are preferably comprised of their own braided strands, and are the same in every way except their color. The strands 2*a*, 2*b* are all together in a single round braid forming the main body segment 3*b*. Where the main body segment 3*b* ends is the beginning of the eyelet 4, the end of the eyelet 4 is when the main body segment 3*b* starts up again. The eyelet 4 can be broken down and understood further by examining its parts. When examining the drawing from left to right, the main body segment 3*b* ends and the strands 2*a*, 2*b* starts reorganizing creating a first transition cycle 5*a*. In the first transition cycle 5*a* the braiding pattern changes sending the four darker color strands 2*a* to form the darker color eyelet branch 6*a*, and the four lighter color strands 2*b* to form the lighter color eyelet branch 6*b*; both branches 6*a*, 6*b* are round braids and of the same length. At the second transition cycle 5*b* the two branches 6*a*, 6*b* reunite by organizing the strands 2*a*, 2*b* back into a single braid until the main body segment 3*b* commences again. The first and second transition cycles 5*a*, 5*b* are the same braid, just in reverse. In some embodiments (not illustrated), although not preferred, the string, rope, or strap 1 could be a thin strap with the eyelets 4 added afterwards; this is done by cutting a slit and reinforcing the area, like a buttonhole is formed.

Figure 3B:
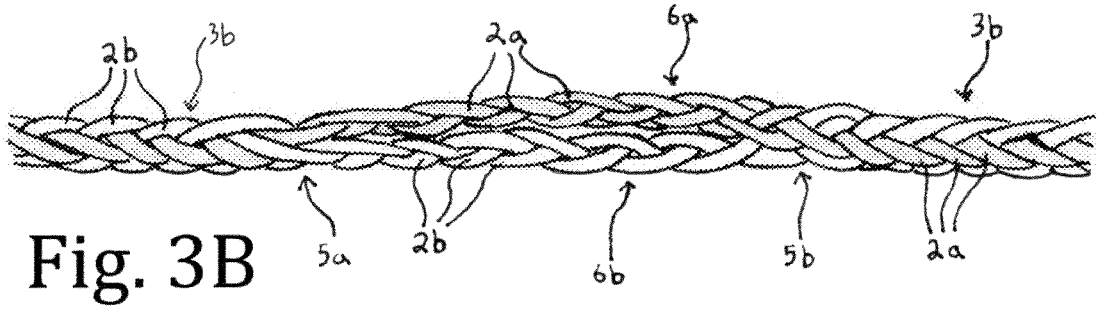
FIG. 3B is a close up drawing of the same flexible eyelet as FIG. 3A but with the eyelet closed; how it would look if there were a load on it.

Referencing FIG. 3B, is a close up of the same eyelet 4 as FIG. 3A, but with the eyelet 4 pulled closed. When this eyelet 4 is closed it hardly protrudes with respect to the main body segments 3*b*, this allows for the string, rope, or strap 1 to be used without the eyelets 4 posing an obstructive presents. The two eyelet branches 6*a*, 6*b* are braided round like the main body segments 3*b*, just with half of the eight strands 2*a*, 2*b*. Like in the present example, one of the most preferred embodiments has round body segments 3*a*, 3*b* and round eyelet branches 6*a*, 6*b*. Although preferred the two branches 6*a*, 6*b* do not have to be a similar braid to the body segments 3*a*, 3*b*. In the preferred embodiments there is a visual aid to help easily find the eyelets, even when the string, rope, or strap 1 is under a load. Here this is done by using different color strands 2*a*, 2*b* that braid accordingly to make one eyelet branch 6*a* darker, and the other eyelet branch 6*b* lighter. This is one of the best ways to mark the eyelets 4; other un-preferred ways might include paint after braiding.

Figure 4A:
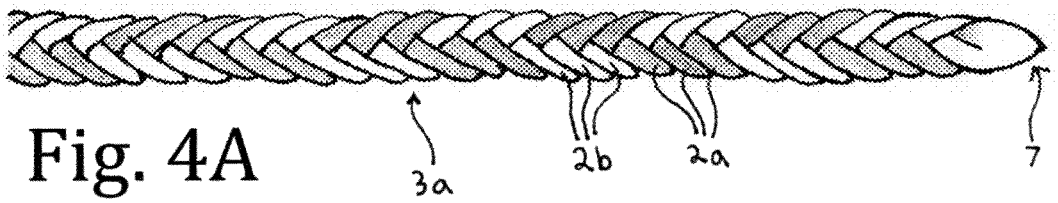
FIG. 4A is a close up drawing of an end body segment leading to the tip of a six-strand flat braided rope.

Referencing FIG. 4A, is a close up of the end of a six-strand flat braided embodiment of the string, rope, or strap 1. Although this is not one of the most preferred embodiments, it is acceptable and helps illustrate certain points very well. Like in this embodiment the string, rope, or strap 1 is made with a minimum of six strands 2*a*, 2*b*, but it may be made with more and increases by two. The six strands 2*a*, 2*b* that make up the end body segment 3*a*, terminates at the tip 7. The tip 7 is finished as to prevent fraying, and is embellished as to assist while using the string, rope, or strap 1. This embellishment is accomplished by dipping the tip 7 in something such as resin or epoxy, or even by strategic melting of the strands 2*a*, 2*b*, in order to make the tip 7 more rigid and taper to a rounded point. The premise being that the hardened tip 7 allows the user to more easily push the tip 7 through an eyelet 4 when it is closed due to a load on the string, rope, or strap 1, like in FIG. 3B. Also, the strands 2*a*, 2*b* in this embodiment are braided in such a way as to indicate a measurement, in this case a half-inch. The three dark strands 2*a* together on one side of the end body segment 3*a* make a half-inch long section, subsequently the light strands 2*b* also measure a half-inch. So the user can lay the body segments 3*a*, 3*b* against a surface using the string, rope, or strap 1 as a sort of makeshift ruler.

Figure 4B:
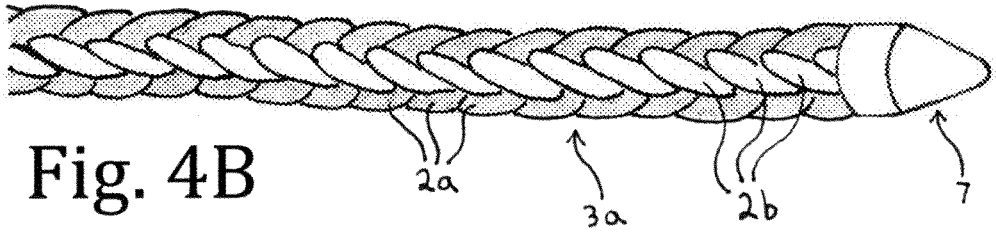
FIG. 4B is a close up drawing of an end body segment leading to the tip of an eight-strand round braided rope.

Referencing FIG. 4B, is a close up of the end of an eight-strand round braided embodiment of the string, rope, or strap 1. Like FIG. 4A, the end body segment 3*a* terminates with a hardened tip 7. Here the tip 7 is made more rigid by an attached piece, consisting of plastic or metal, which slips over the end of the strands 2*a*, 2*b* and tapers into a rounded point.

Figure 5A:
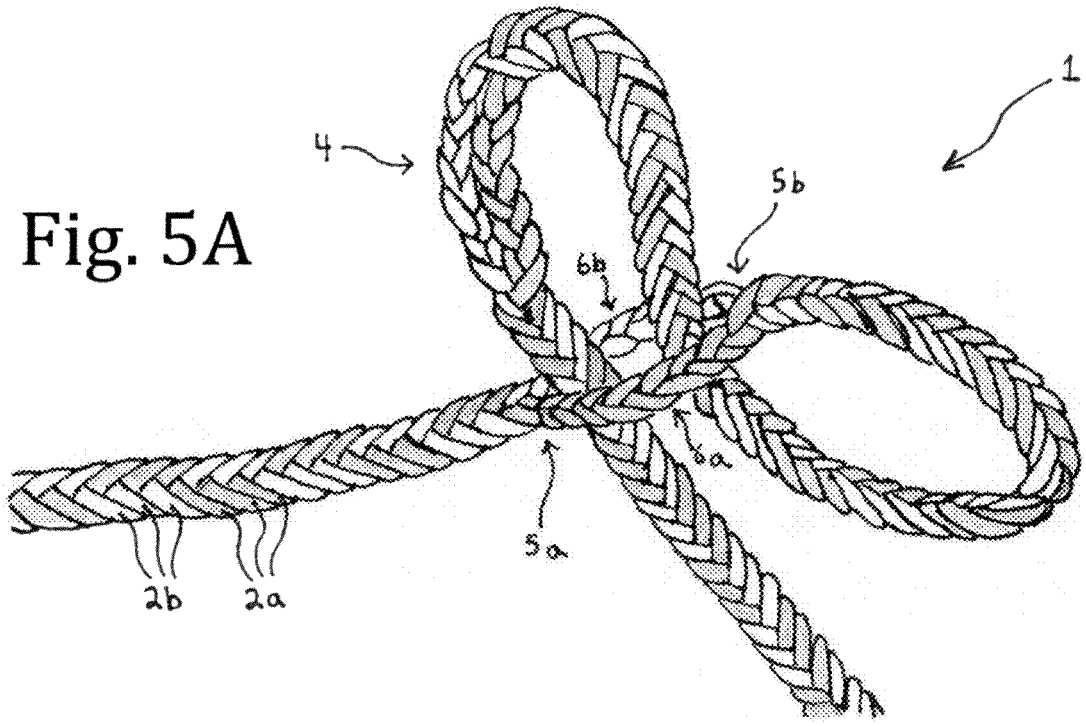
FIG. 5A is a drawing of a six-strand flat braided rope being pulled in on itself through one of its flexible eyelets.

Referencing FIG. 5A, the string, rope, or strap 1 is being pulled in on itself though one of its eyelets 4. The size of the eyelet 4, is subject in all embodiments to being at least large enough for any part of the string, rope, or strap 1 to be able to, when folded once, pass through an eyelet 4. The eyelets 4 are preferably larger than the minimum this allows for the string, rope, or strap 1 to easily pull through the eyelet 4. In this embodiment the string, rope, or strap 1 has a main body segment 3*b* that measures fourteen inches long with an eyelet that measures two inches long (its strands 2*a*, 2*b* are not braided as to indicate a measurement, like that of FIG. 4A). This puts the eyelets 4 at sixteen inches on center, and is about as distant as the eyelets 4 can be comfortably be placed in most embodiments.

Figure 5B:
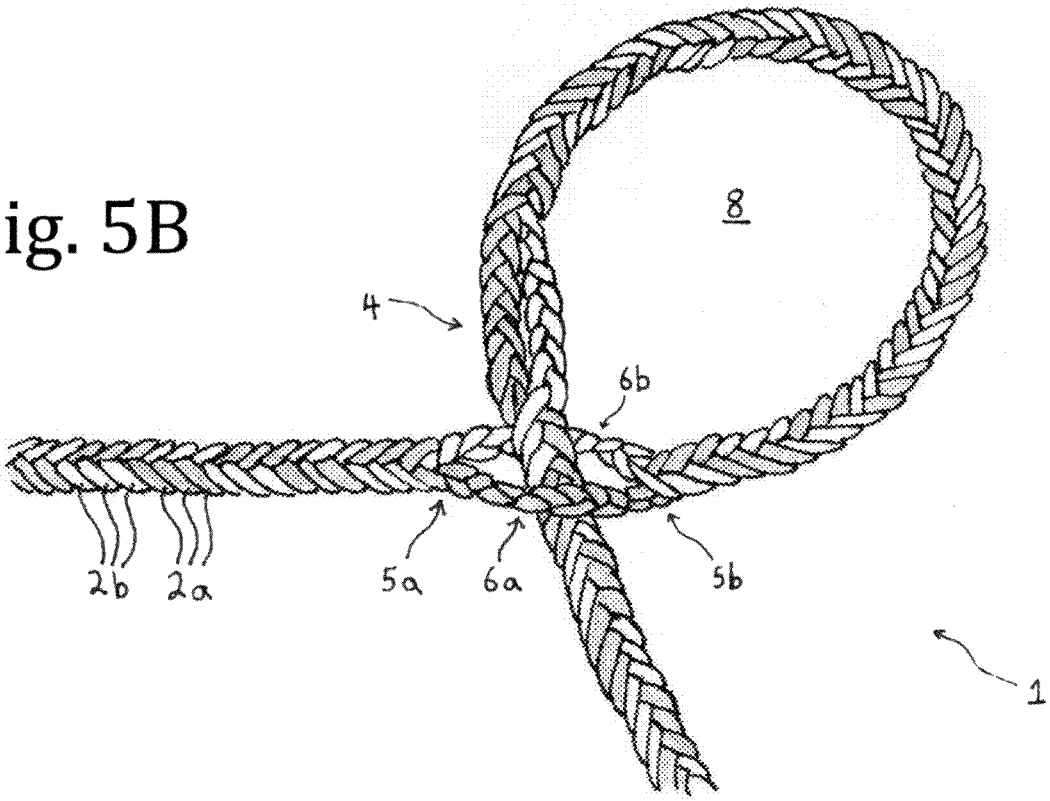
FIG. 5B is a drawing of the same six-strand rope of FIG. 5A, but in a further stage, of being pulled in on itself through one of its flexible eyelets.

Referencing FIG. 5B, the string, rope, or strap 1 is the same as FIG. 5A and shows a further stage of the action taken in FIG. 5A. Here the string, rope, or strap 1 has been pulled in on itself though one of its eyelets 4, making a loop 8 that is adjustable in size and can be thrown around a pole or other such object to secure the string, rope, or strap 1. In making the loop 8, the transition cycle area 5*b* flips around completely until it is in the same position as it began, the two eyelet branches 6*a*, 6*b* are twisted to compensate. The loop 8 can easily be pulled out and the string, rope, or strap 1 will return to normal.

The detailed descriptions above went through many of the large range of possible and preferred embodiments and what is unique about the present invention. The following claims should give someone skilled in the arts an even better understanding of the present invention, in term of its requirements and its restriction.

What is claimed:

1. A continuous braided rope having a first end, a second end and a main body between the first end and the second end, comprising:

a plurality of strands extending from the first end through the main body and to the second end, said plurality of strands braided all together into a single braid over most of a length of the continuous braided rope, said single braid bifurcating into two parallel braids including subsets of the plurality of strands and then rejoining into the single braid, the two parallel braids forming a flexible eyelet, said continuous rope including a plurality of evenly-spaced flexible eyelets along the main body, said eyelets dividing the main body into a plurality of main body segments of equal lengths, wherein a length of an eyelet from bifurcation to rejoinder when the continuous braided rope is pulled taut is an eyelet length;

each eyelet is at least large enough to allow any other portion of the continuous braided rope, folded once, to pass therethrough; and a length of a main body segment between two eyelets is at least as long as the eyelet length but no longer than twenty times the eyelet length.

2. The continuous braided rope of claim 1 wherein adjacent flexible eyelets are spaced apart from each other by twelve (12) inches.

3. The continuous braided rope of claim 1 wherein the plurality of strands are formed from a fiber chosen from the group consisting of polyester, Kevlar® and Dyneema®.

4. The continuous braided rope of claim 1 wherein the single braid is a round braid, and the two parallel braids are flat braids.

5. The continuous braided rope of claim 1 wherein the flexible eyelets are reinforced by one of whipping, sewing or applying a stiffener to the flexible eyelets at bifurcation and rejoinder locations.

6. The continuous braided rope of claim 1 wherein the first end and the second end are a uniform length.

7. The continuous braided rope of claim 1 wherein a first strand of the plurality of strands is a first color and a second strand of the plurality of strands is a second, different color, and wherein the first strand and the second strand are braided into different braids of the two parallel braids so that one side of a flexible eyelet is a different color from another side of the flexible eyelet.

8. The continuous braided rope of claim 1 wherein the first end and the second end are treated to increase their rigidity.

9. A continuous woven strap having a first end, a second end and a main body between the first end and the second end, comprising:

a plurality of strands extending from the first end through the main body and to the second end, said plurality of strands woven all together into a single woven strap over most of a length of the continuous woven strap;

a plurality of slits formed at uniform intervals through the continuous woven strap, said slits having a uniform slit length and oriented parallel to a length of the strap, wherein a slit is at least large enough to allow any other portion of the continuous woven strap, folded once, to pass through the slit;

a slit is no longer than ten times a minimum slit length that can accommodate any other portion of the continuous woven strap folded once; and a portion of the main body lying between two successive slits is at least as long as the uniform slit length and no greater than twenty times the uniform slit length, and wherein the first end and the second end of the continuous woven strap have no slits formed therein.

10. The continuous woven strap of claim 9, wherein a distance from one slit to an adjacent slit is twelve (12) inches.

11. The continuous woven strap of claim 9, wherein each slit is approximately two (2) inches long.

12. The continuous woven strap of claim 9, wherein the first end and the second end are equal in length.

13. The continuous woven strap of claim 9, wherein the first end and the second end are longer than portion of the main body between two successive slits.

14. The continuous woven strap of claim 9, wherein the first end and the second end are approximately twenty-three (23) inches long.

15. The continuous woven strap of claim 9, further comprising:

a first piece attached to the first end; and a second piece attached to the second end, said first piece and second piece configured to terminate the first end and the second end in hardened, rounded points.

16. The continuous woven strap of claim 15, wherein the first piece is made of plastic or metal.

17. A continuous twisted rope having a first end, a second end and a main body between the first end and the second end, comprising:

a plurality of strands extending from the first end through the main body and to the second end, said plurality of strands twisted all together into a single continuous twisted rope over most of a length of the continuous twisted rope, said single continuous twisted rope bifurcating to into two parallel twisted rope segments, each of the parallel twisted rope segments containing different subsets of the plurality of strands, said two parallel twisted rope segments rejoining into the single continuous twisted rope including all of the plurality of strands, the two parallel twisted rope segments forming a flexible eyelet, said main body including a plurality of flexible eyelets spaced equally along a length of the main body, said plurality of eyelets dividing the main body into a plurality of main body segments of equal length, wherein each flexible eyelet is large enough to admit any portion of the continuous twisted rope folded once;

each flexible eyelet is smaller than ten times a minimum size of an eyelet that could admit any portion of the continuous twisted rope folded once; and a length of each main body is less than twenty times the minimum size of an eyelet.

18. The continuous twisted rope of claim 17, wherein the plurality of strands are composed of a low-stretch material chosen from the group consisting of polyester, Kevlar® and Dyneema®.

19. The continuous twisted rope of claim 17, wherein the first end is longer than a main body segment between two adjacent flexible eyelets.

20. The continuous twisted rope of claim 17, wherein a first strand of the plurality of strands is a first color, and a second strand of the plurality of strands is a second, different color.

21. The continuous twisted rope of claim 20, wherein the first strand of the plurality of strands is part of a first of the two parallel twisted rope segments, and the second strand of the plurality of strands is part of a second of the two parallel twisted rope segments, so that the first of the two parallel twisted rope segments is visually different from the second of the two parallel twisted rope segments.

22. The continuous twisted rope of claim 17, wherein the first end comprises a hardened, rounded tip.

23. The continuous twisted rope of claim 17, wherein the plurality of strands at the first end are hardened by melting the plurality of strands together.

* * * * *